US006402140B1

(12) United States Patent
Wood

(10) Patent No.: US 6,402,140 B1
(45) Date of Patent: Jun. 11, 2002

(54) AUTOMATIC BALL-STARTING DEVICE OF FOOTBALL GAME TABLE

(75) Inventor: George Wood, Hsi-Chih (TW)

(73) Assignee: TBS Group Corporation, Taipei Hsien (TW)

( * ) Notice: Subject to any disclaimer, the term of this patent is extended or adjusted under 35 U.S.C. 154(b) by 0 days.

(21) Appl. No.: 09/760,760

(22) Filed: Jan. 17, 2001

(51) Int. Cl.[7] ..... A63F 7/06

(52) U.S. Cl. ..... 273/108.1; 273/119 A; 273/129 S; 273/118 A; 273/126 A; 273/122 A

(58) Field of Search ..... 273/129 S, 126 R, 273/118 A, 121 D, 122 A, 121 A, 126 A, 119 A, 125 R, 125 A, 123 A, 118 D, 108.1, 108.4, 394, 395, 396, 397, 108.41, 108.5, 108.51, 108.52, 108.53, 108.54, 108.55, 108.56, 108.57; 473/134, 136

(56) References Cited

U.S. PATENT DOCUMENTS 3,927,885 A * 12/1975 Crossman
4,173,338 A * 11/1979 Barnett
4,480,833 A * 11/1984 Barcelow
5,350,174 A * 9/1994 Ritchie
5,931,465 A * 8/1999 Miyake

* cited by examiner

*Primary Examiner*—Sebastiano Passaniti
(74) *Attorney, Agent, or Firm*—Dennison, Schultz & Dougherty

(57) ABSTRACT

Automatic ball-starting device of football game table, including multiple ball-guiding tubes and a controlling box. Two ball-guiding tubes respectively extend from two goals on two sides of the football game table to the controlling box disposed at the center thereof. The ball-guiding tubes are communicated with a ball-striking chamber of the controlling box. A ball-striking tube is connected with the ball-striking chamber and extends to a middle portion of the face of the football game table. Two controlling buttons extend from the controlling box to two sides of the football game table. A controlling circuit is disposed in the controlling box for detecting whether there is a ball in the ball-striking chamber. If so, a speaker is driven to emit a message to remind the players. After either of the controlling buttons is pressed, after a delay of several seconds, the controlling circuit is closed to power on the driving coil. The driving coil generates a magnetic field to drive the ball-striking rod to strike a ball so as to automatically start the ball.

6 Claims, 5 Drawing Sheets

AUTOMATIC BALL-STARTING DEVICE OF FOOTBALL GAME TABLE

BACKGROUND OF THE INVENTION

The present invention is related to an automatic ball-starting device of football game table. The ball-starting device enables a user to have full time for preparation. The ball-starting device is also applicable to other game tables.

A conventional football game table has multiple dolls mounted on rotary rod bodies for driving a ball placed on the face of the football game table. A player scores when rolling the ball into a goal of the football game table. It is important to play such game fairly.

When starting the ball, one of the players must pick up the ball from a ball box under the football game table and then directly drop the ball into the center of the football game table to start the game. Accordingly, the players must frequently pick up and drop the ball. Such movement is troublesome for both players and will lower the fun in playing the game. Moreover, the game can be hardly fairly played under such condition that the ball is manually dropped onto the table face by one of the players. Therefore, it is necessary to develop an automatic ball-starting device of football game table, which can automatically start the ball and make the players to fairly play the game.

SUMMARY OF THE INVENTION

It is therefore a primary object of the present invention to provide an automatic ball-starting device of football game table. By means of the automatic ball-starting device, the ball can be automatically collected and started.

It is a further object of the present invention to provide the above automatic ball-starting device of football game table, in which there is a delay of time prior to starting the ball so that the player starting the ball can have a full time for preparation.

It is still a further object of the present invention to provide the above automatic ball-starting device of football game table, which can save power and prolong the using life of the driving coil.

According to the above objects, the automatic ball-starting device of football game table of the present invention includes multiple ball-guiding tubes and a controlling box. Two ball-guiding tubes respectively extend from two goals on two sides of the football game table to the controlling box disposed at the center thereof. The ball-guiding tubes are communicated with a ball-striking chamber of the controlling box. A ball-striking tube is connected with the ball-striking chamber and extends to a middle portion of the face of the football game table. Two controlling buttons extend from the controlling box to two sides of the football game table. A controlling circuit is disposed in the controlling box for detecting whether there is a ball in the ball-striking chamber. If so, a speaker is driven to emit a message to remind the players. After either of the controlling buttons is pressed, after a delay of several seconds, the controlling circuit is closed to power on the driving coil. The driving coil generates a magnetic field to drive the ball-striking rod to strike a ball so as to automatically start the ball.

The present invention can be best understood through the following description and accompanying drawings wherein:

DETAILED DESCRIPTION OF THE PREFERRED EMBODIMENTS

Figure 1:
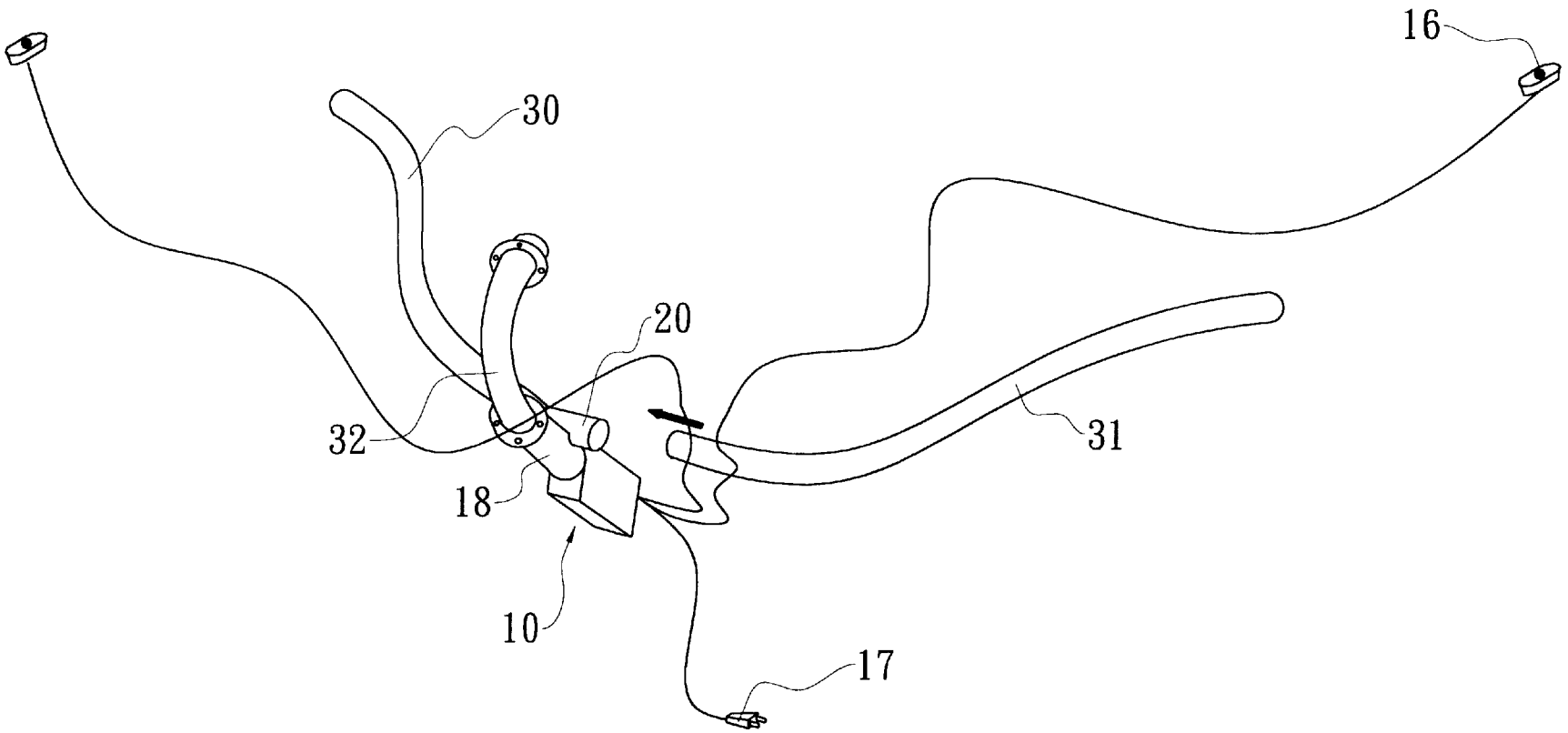
FIG. 1 is a perspective view of the present invention.
Figure 2:
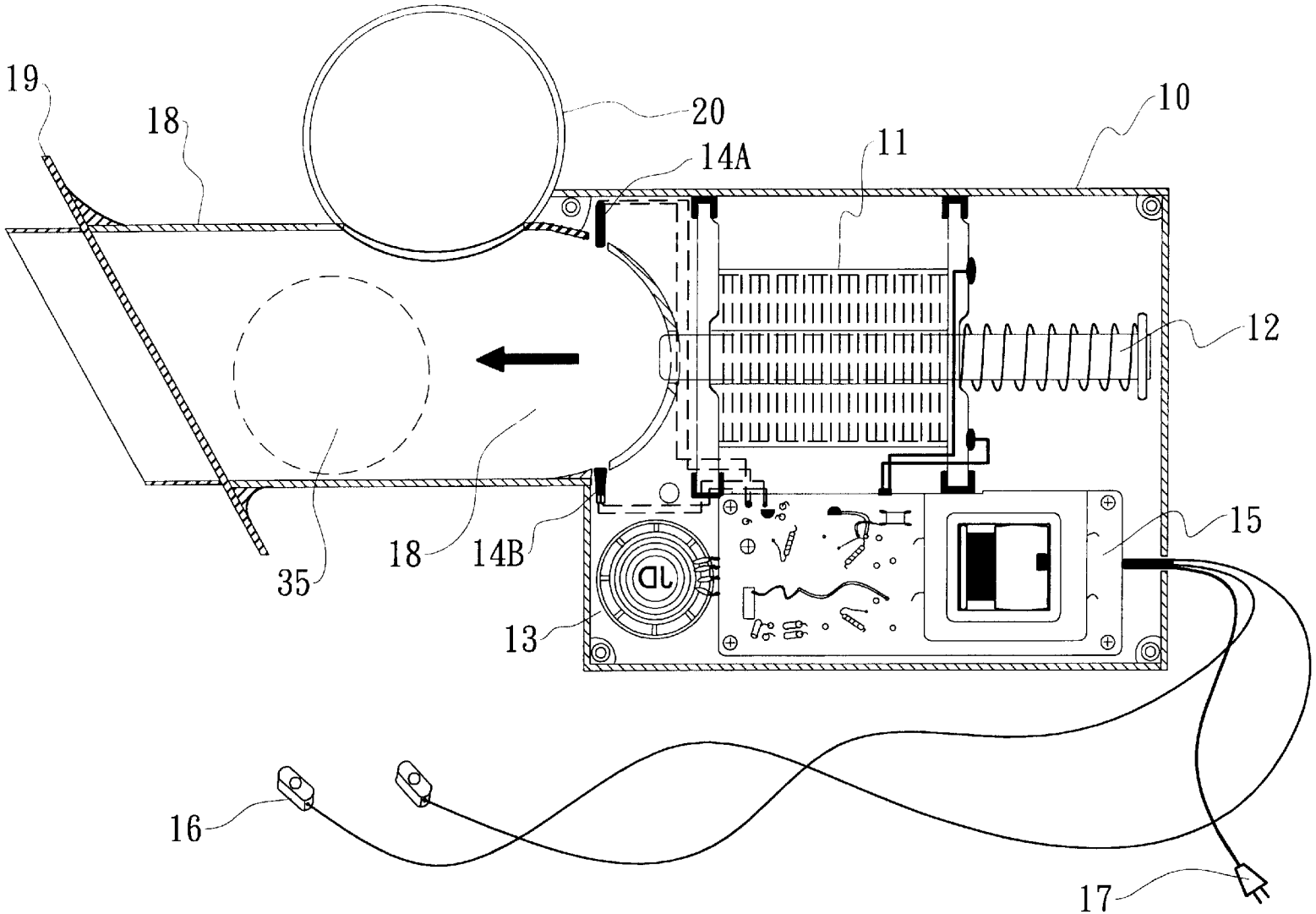
FIG. 2 is a sectional view of the controlling box of the present invention.
Figure 3:
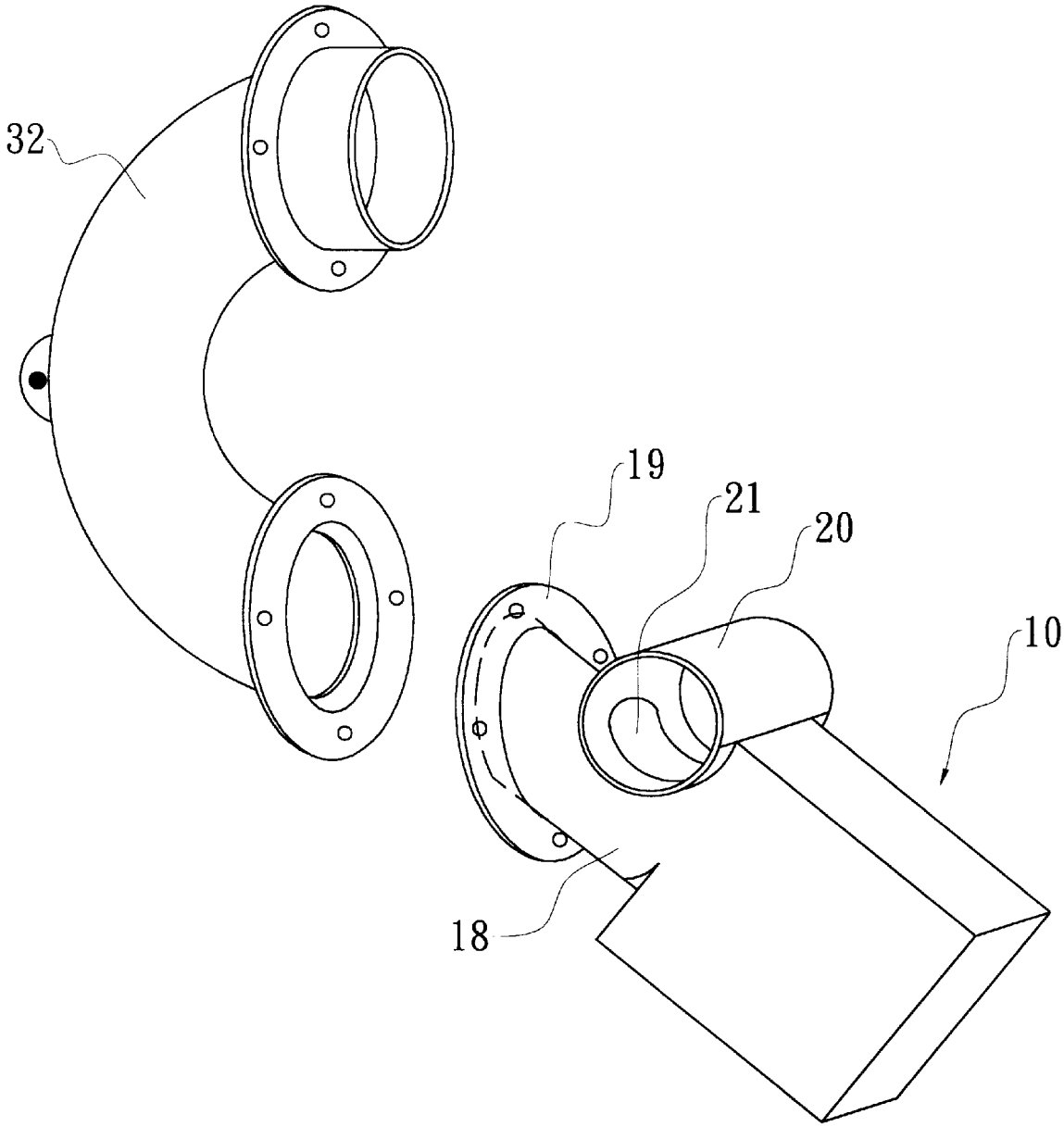
FIG. 3 is a perspective view showing the connection between the controlling box and the ball-striking tube of the present invention.

Please refer to FIGS. 1 to 3. The ball-starting device of the present invention includes a controlling box 10 and multiple tube bodies. The controlling box 10 is a rectangular box body with a certain dimension. A tube body perpendicularly extends from a short side of the box body to form a ball-striking chamber 18. A connecting section 19 is formed on an outer circumference of a front end of the ball-striking chamber 18 for connecting with a bent ball-striking tube 32. In addition, the ball-striking chamber 18 is transversely formed with another connecting section 20 near the upper edge of the box body. An adjoining portion between the connecting section 20 and the ball-striking chamber 18 is formed with a communicating through hole 21 (as shown in FIG. 3). A pair of sensors 14 are disposed in the controlling box 10 at the rear end of the ball-striking chamber 18. A driving coil 11 is positioned beside the sensors 14. A ball-striking rod 12 is fitted in the center of the driving coil 11. A speaker 13 is positioned under the sensors 14. A controlling circuit 15 is arranged beside the speaker 13 for collectively controlling the sensors 14, the driving coil 11 and the speaker 13. Two controlling buttons 16 and a power plug 17 extend from the controlling circuit 15 as shown in FIG. 2.

Figure 5:
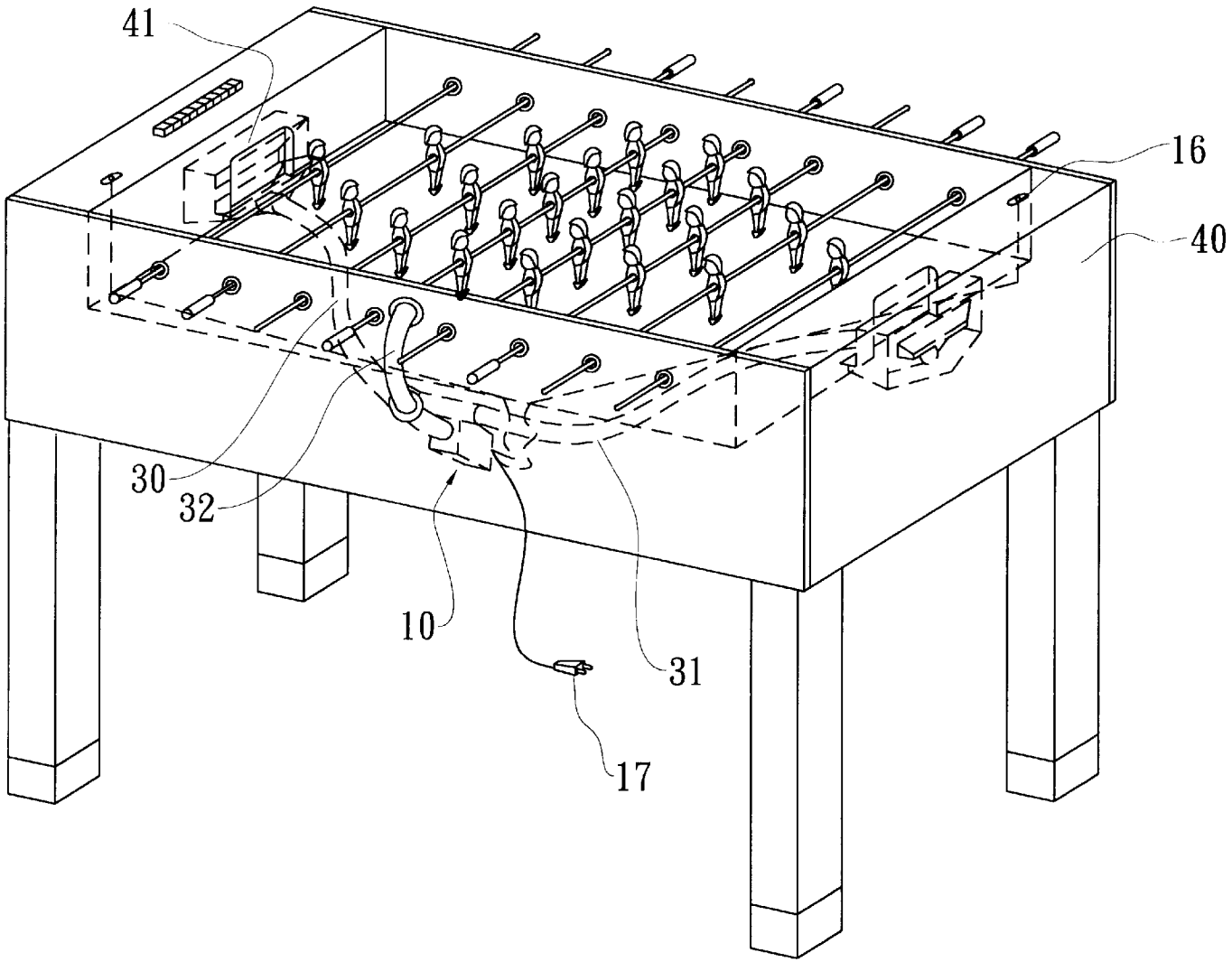
FIG. 5 shows that the present invention is mounted on a football game table.

Please refer to FIG. 5. First, with the ball-striking chamber 18 directed upward, the controlling box 10 is inclinedly connected with the lower edge of one long side of the football game table 40. Then the connecting section 19 of the ball-striking chamber 18 is coupled with one end of the ball-striking tube 32. The other end of the ball-striking tube 32 is inserted in an insertion hole formed on the football game table 40. The opening of the ball-striking tube 32 is directed to an inner side of the football game table. In addition, the connecting section 20 of the upper side of the ball-striking chamber 18 via two ball-guiding tubes 30, 31 is connected to the bottoms of the two goals 41 on two sides of the football game table 40. Also, the two controlling buttons 16 extending from the controlling box 10 are respectively mounted on two short sides of the football game table 40.

Figure 4:
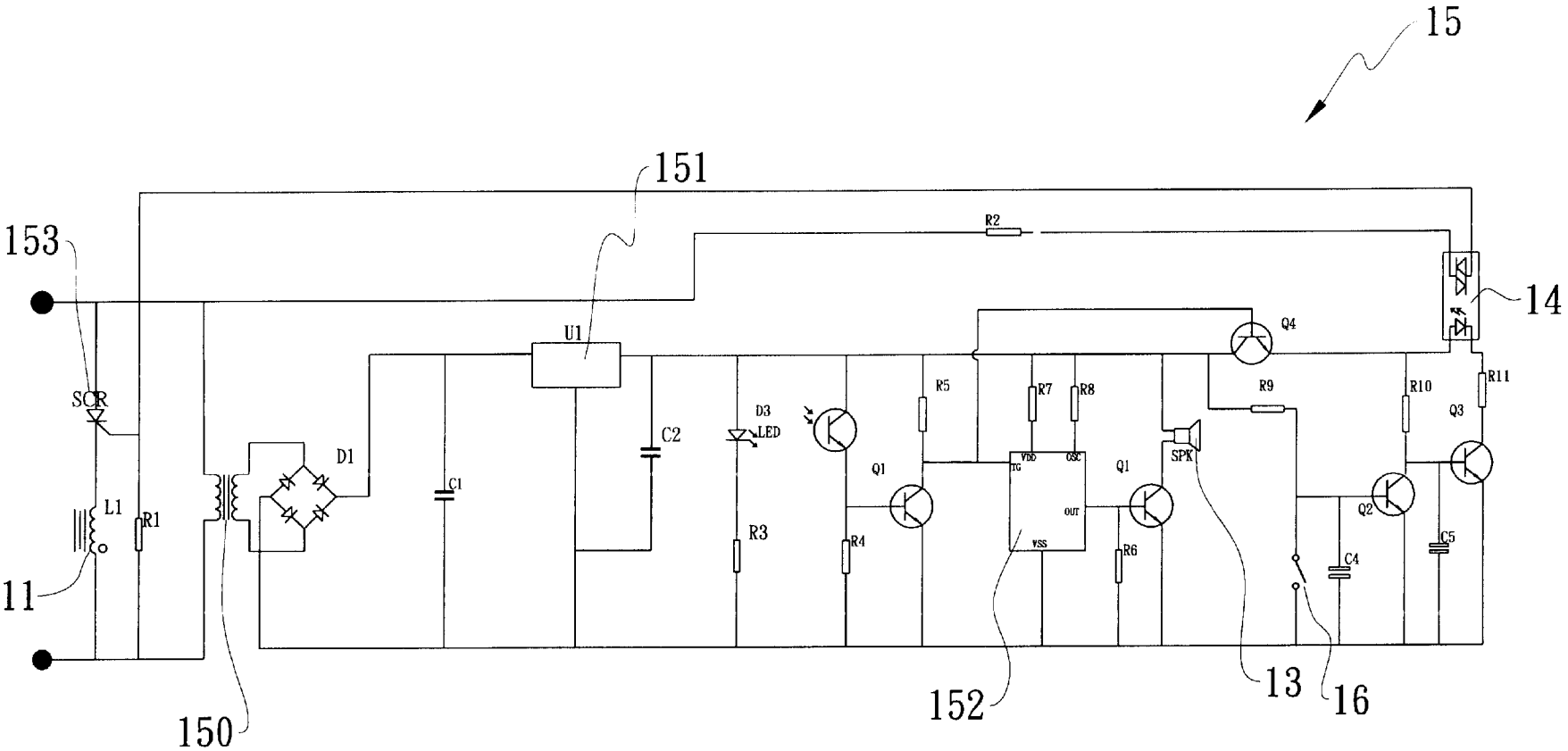
FIG. 4 is a circuit diagram of the controlling circuit of the present invention.

Referring to FIG. 4, the controlling circuit 15 is composed of multiple resistors, capacitors, diodes, transistors, a transformer coil 150, a stabilized IC 151, a monostable multivibrator 152, a silicon-controlled rectifier (SCR) 153, a driving coil 11, a speaker 13, a sensor 14 and two controlling buttons 16. When a ball 35 goes through any of the goals 41 and the ball-guiding tube 30 and enters the ball-striking chamber 18 from the through hole 21 of the connecting section 20, due to the inclination of the ball-striking chamber 18, the ball 35 will roll to the bottom thereof. At this time, the sensor 14 in the ball-striking chamber 18 will detect the ball 35 in the ball-striking chamber 18 and send a signal to the controlling circuit 15. In a preferred embodiment, the sensor 14 is composed of an infrared transmitter 14A and an infrared receiver 14B. When the ball 35 interrupts the infrared beam, the ball 35 is detected. The silicon-controlled rectifier (SCR) 153 is a one-way conductive element. Therefore, the signal will trigger the gate of the silicon-controlled rectifier (SCR) 153 to close the circuit. The stabilized IC 151 provides a stable voltage. The monostable multivibrator 152 is triggered to output a signal from the output terminal. At this time, the speaker 13 emits a reminding sound. Also, after about a 3 second delay, the driving coil 11 generates a magnetic field for driving the ball-striking rod 12 to strike out the ball 35. As a result, the ball 35 is struck to move along the ball-striking tube 32 to the field. Accordingly, the ball 35 can be automatically started.

Once the ball 35 leaves the ball-striking chamber 18, the sensor 14 no more detects the ball 35 and no signal will be sent to the controlling circuit 15. At this time, the silicon-controlled rectifier (SCR) 153 is not conductive so that the circuit is opened. Under such circumstance, in case a player repeatedly or continuously presses down the controlling button 16, the circuit will not work so that the power can be saved and the driving coil 11 is prevented from being over-used.

According to the above arrangement, the automatic ball-starting device of football game table of the present invention has the following advantages:

1. The ball can be automatically collected and started. It is no more necessary for the players to pick up the ball and start the ball. Also, there can be a fair play.
2. The reminding sound can remind the players of the ball-starting time. In addition, there is a delay of time so that the player starting the ball can have a full time for preparation.
3. Either of the players can start the ball. Once the ball leaves the ball-striking chamber, the ball-starting device is immediately powered off so that the power will not be wasted. Also, the driving coil is prevented from being over-used and thus is protected from being damaged.

The above embodiments are only used to illustrate the present invention, not intended to limit the scope thereof. Many modifications of the above embodiments can be made without departing from the spirit of the present invention.

What is claimed is:

1. In combination, an automatic ball-starting device and a football game table, said game table including a plurality of sides that confine a playing surface and at least two goals defined within two of said plurality of sides and situated on opposite ends of the table, each said goal including an opening facing onto the playing surface of the game table and a bottom portion communicating with said opening for collecting a spent ball; another one of said plurality of sides defining a face plane extending between said opposite ends;

said ball starting device comprising a controlling box and two ball-guiding tubes respectively extending from said bottom portion of each of said goals to said controlling box that is disposed generally beneath the playing surface at a location generally midway between said two goals; said ball-guiding tubes communicating with a ball-striking chamber located within the controlling box;

a ball-striking tube operatively connected with said ball-striking chamber and extending to the face plane of the football game table;

said controlling box further including a driving coil that generates a magnetic field and a ball-striking rod driven by the magnetic field and used for striking a ball, wherein the struck ball is moved along said ball-striking tube towards the face plane and onto the playing field;

at least two player-activated controlling buttons extending from the controlling box respectively to said opposite ends of the table, wherein a player may selectively activate the ball-striking chamber to release a ball onto the playing field;

said ball-striking chamber further including a sensor electrically connected with a controlling circuit that is disposed within said controlling box, wherein the sensor detects the presence of a ball within the ball-striking chamber so as to control the operation of said driving coil in said ball-striking rod.

2. The combination of claim 1, wherein the sensor is a photo electric coupler.

3. The combination of claim 1, wherein the sensor is composed of an infrared transmitter and an infrared receiver.

4. The combination of claim 1, wherein said controlling box includes a front end and an upper edge and wherein said controlling box is formed with a transverse connecting section perpendicular to the ball-striking chamber projecting from said controlling box.

5. The combination of claim 4, wherein the connecting section is formed with a through hole for communicating with the ball-striking chamber.

6. The combination of claim 1, wherein the controlling box is disposed below the plane surface and at an inclined angle with respect to the plane surface.

* * * * *